US005383514A

United States Patent [19]

Taguchi et al.

[11] Patent Number: 5,383,514

[45] Date of Patent: Jan. 24, 1995

[54] VACUUM CASTING APPARATUS

[75] Inventors: Masahiro Taguchi, Nagoya; Yoshiro Hayashi, Toyota; Ryuichi Masuda, Okazaki; Yoshio Ekino, Toyota, all of Japan

[73] Assignee: Toyota Jidosha Kabushiki Kaisha, Aichi, Japan

[21] Appl. No.: 72,999

[22] Filed: Jun. 7, 1993

[30] Foreign Application Priority Data

Jun. 12, 1992 [JP] Japan ..... 4-179198

[51] Int. Cl.[6] ..... B22D 18/06

[52] U.S. Cl. ..... 164/255; 164/254; 164/256

[58] Field of Search ..... 164/155, 257, 254, 256, 164/258, 259, 306, 309, 255, 155.1

[56] References Cited

U.S. PATENT DOCUMENTS 3,322,186 5/1967 Takacs, Jr. ..... 164/306
3,529,753 9/1970 Mack ..... 164/306

FOREIGN PATENT DOCUMENTS 57-4371 1/1982 Japan ..... 164/306
58-196161 11/1983 Japan .
62-3859 1/1987 Japan ..... 164/256
62-24850 2/1987 Japan ..... 164/306
63-60063 3/1988 Japan .
63-84757 4/1988 Japan .
1-96251 6/1989 Japan .
3-31486 7/1991 Japan .
4270055 9/1992 Japan ..... 164/254
5104232 4/1993 Japan ..... 164/306

*Primary Examiner*—P. Austin Bradley
*Assistant Examiner*—Erik R. Puknys
*Attorney, Agent, or Firm*—Oliff & Berridge

[57] ABSTRACT

A vacuum casting apparatus includes a molten metal passage for delivering molten metal into a sprue of a casting die encapsulated in a enclosure, a cylindrical stoke for communicating the molten metal passage with a reservoir tank, a stoke connecting member for biasing the stoke to a member on which the molten metal passage is formed, an auxiliary flange positioned around the stoke connecting member and contacting a surface of said enclosure, and a flexible plate member for air tightly closing a space between the stoke connecting member and the auxiliary flange.

5 Claims, 4 Drawing Sheets

VACUUM CASTING APPARATUS

BACKGROUND OF THE INVENTION

The present invention relates to a vacuum casting apparatus including a casting die and an enclosure encapsulating the casting die and constructed in a manner that a cavity of the casting die is depressurized, when the interior of the enclosure is evacuated, thereby to permit introduction of molten metal in a reservoir tank into the cavity.

A conventional vacuum casting apparatus is found in, for example, Japanese Laid-Open Patent Publication No. 63-60063.

As shown in FIG. 4, the prior art vacuum casting apparatus includes a casting die 3 constituted of an upper die 3*a* and a lower die 3*b*. The casting die 3 is mounted on an enclosure mount 4. The casting die 3 has a sprue 3*y* formed on the lower portion thereof. The sprue 3*y* is communicated with a molten metal passage 4*k* formed on the enclosure mount 4. Furthermore, the casting die 3 is encapsulated by an enclosure 9 hermetically mounted on the enclosure mount 4. The enclosure 9 is connected to a vacuum pump 9*p* for evacuating the interior thereof.

The casting apparatus also includes a cylindrical stoke 10 mounted on the lower surface of the enclosure mount 4 and communicating with the molten metal passage 4*k* of the enclosure mount 4. The stoke 10 has an annular flanged portion 10*t* through which the stoke 10 is connected to the lower surface of the enclosure mount 4. The flanged portion 10*t* is provided with a sealing member 26 so as to form hermetic sealing between the stoke 10 and the enclosure mount 4. The stoke 10 has a distal end which is immersed in molten metal 2 in a reservoir tank 20.

In casting operation, the vacuum pump 9*p* is actuated to evacuate the interior of the enclosure 9, thereby to depressurize a cavity 31 of the casting die 3. As a result, the molten metal 2 in the reservoir tank 20 is drawn into the cavity 31 through the stoke 10 and the molten metal passage 4*k*.

In such a conventional casting apparatus, the stoke 10 and the molten metal passage 4*k* are filled with the molten metal 2 when the molten metal 2 is drawn into the cavity 31 of the casting die 3. Therefore, the enclosure mount 4 at an area around the molten metal passage 4*k* expands radially and vertically with heat from the molten metal 2. If the area around the molten metal passage 4*k* expands vertically, the casting die 3 is upwardly biased and the stoke 10 is downwardly biased. However, as the upper surface of the area around the molten metal passage 4*k* is applied with a heavy load due to the weight of the casting die 3, the area around the molten metal passage 4*k* is mainly downwardly deformed or expands with the heat from the molten metal 2. This downward expansion of such an area of enclosure mount 4 will result in downward movement of the flanged portion 10*t* of the stoke 10 since it is connected to the lower surface of the enclosure mount 4 with the sealing member 26.

The enclosure mount 4 at the area around the molten metal passage 4*k* has a significant expansion ratio, while at an area away from the molten metal passage 4*k* it has a smaller expansion ratio. Therefore, the enclosure mount 4 at the area away from the molten metal passage 4*k* has a smaller downward deformation. This may lead to non-uniform downward movement of the flanged portion 10*t* of the stoke 10, thereby to form a clearance between the flanged portion 10*t* and the lower surface of the enclosure mount 4. Such a clearance may cause reduction of sealing performance between the enclosure mount 4 and the stoke 10. This may cause gas inclusions into the molten metal 2 and incomplete evacuations of the interior of the enclosure 9 which are factors for producing possible defective products.

SUMMARY OF THE INVENTION

It is an object of the invention to provide a vacuum casting apparatus in which sealing performance between an enclosure and a stoke is not degraded by heat from molten metal drawn through the stoke.

According to the present invention, there is provided a vacuum casting apparatus including a casting die having a cavity and an enclosure encapsulating the casting die, the enclosure being evacuated to depressurize the cavity so that molten metal is drawn into the cavity from a reservoir tank positioned outside the enclosure, comprising a molten metal passage for delivering the molten metal into a sprue of the casting die encapsulated in the enclosure from outside of the enclosure; a cylindrical stoke for communicating the molten metal passage with the reservoir tank, the stoke having an inner bore for flowing the molten metal; a stoke connecting member for biasing one end of the stoke to one end of a member on which the molten metal passage is formed; an auxiliary flange positioned around the stoke connecting member and contacting a surface of the enclosure with a sealing member therebetween; and a flexible plate member for air tightly closing a space between the stoke connecting member and the auxiliary flange.

In the present vacuum casting apparatus, when the molten metal is drawn into the cavity of the casting die, the molten metal passage and the stoke is filled with the molten metal. As a result, the member having the molten metal passage vertically expands with heat from the molten metal, thereby to lower the stoke and the stoke connecting member retaining the stoke.

However, the vacuum casting apparatus includes the auxiliary flange being separate from and positioned around the stoke connecting member. The auxiliary flange remains in contact with the lower surface of the enclosure even if the stoke and the stoke connecting member is downwardly moved. Furthermore, the vacuum casting apparatus includes the flexible plate member for air tightly closing the space between the stoke connecting member and the auxiliary flange. As a result, the stoke is constantly hermetically engaged with the enclosure.

The present invention will become more fully apparent from the claims and the description as it proceeds in connection with the drawings.

DETAILED DESCRIPTION OF THE PREFERRED EMBODIMENTS

Now, a vacuum casting apparatus according to a first embodiment of the invention will be described with reference to FIGS. 1 and 2.

Figure 1:
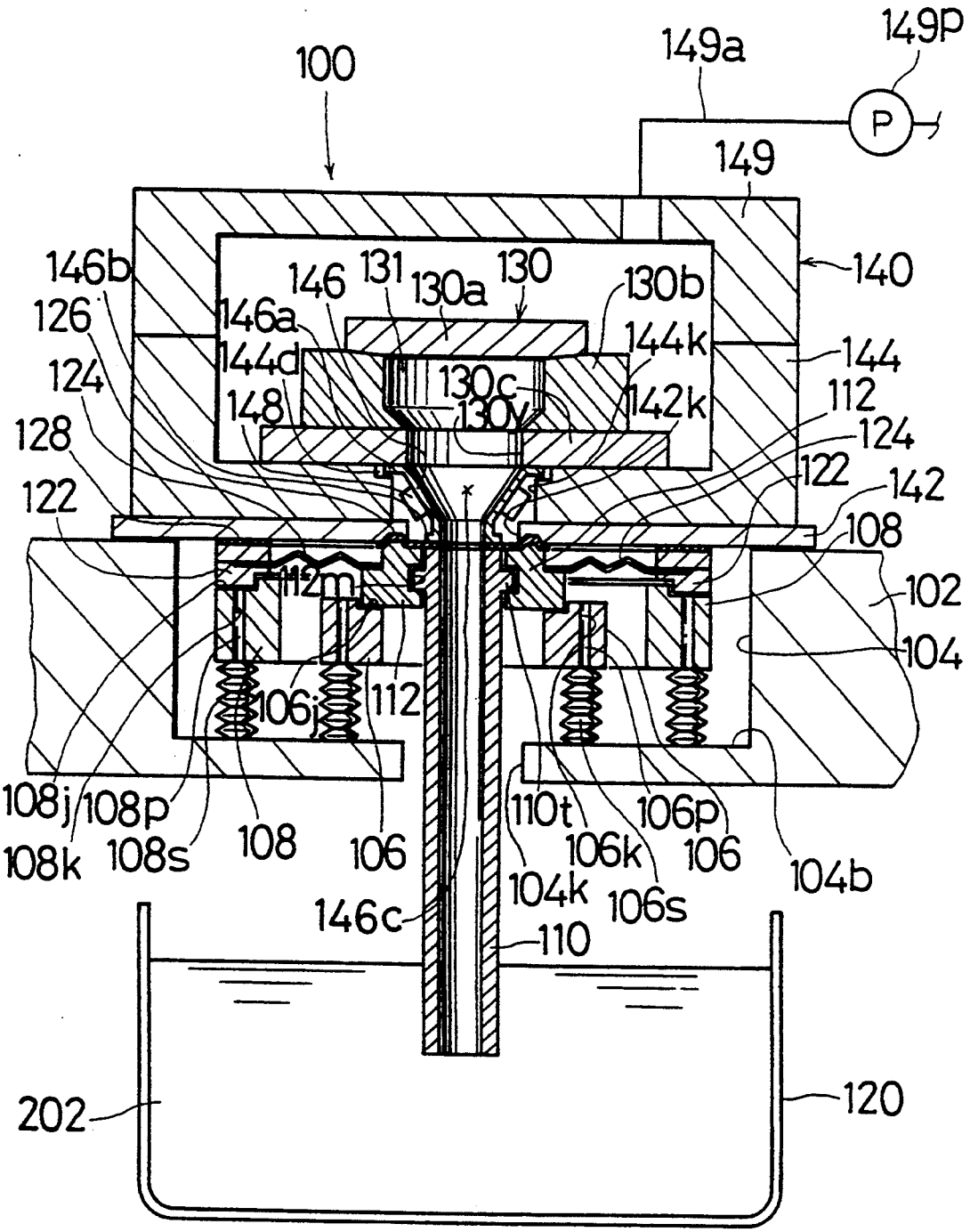
FIG. 1 is a vertical sectional view of a vacuum casting apparatus according to a first embodiment of the present invention.
Figure 2:
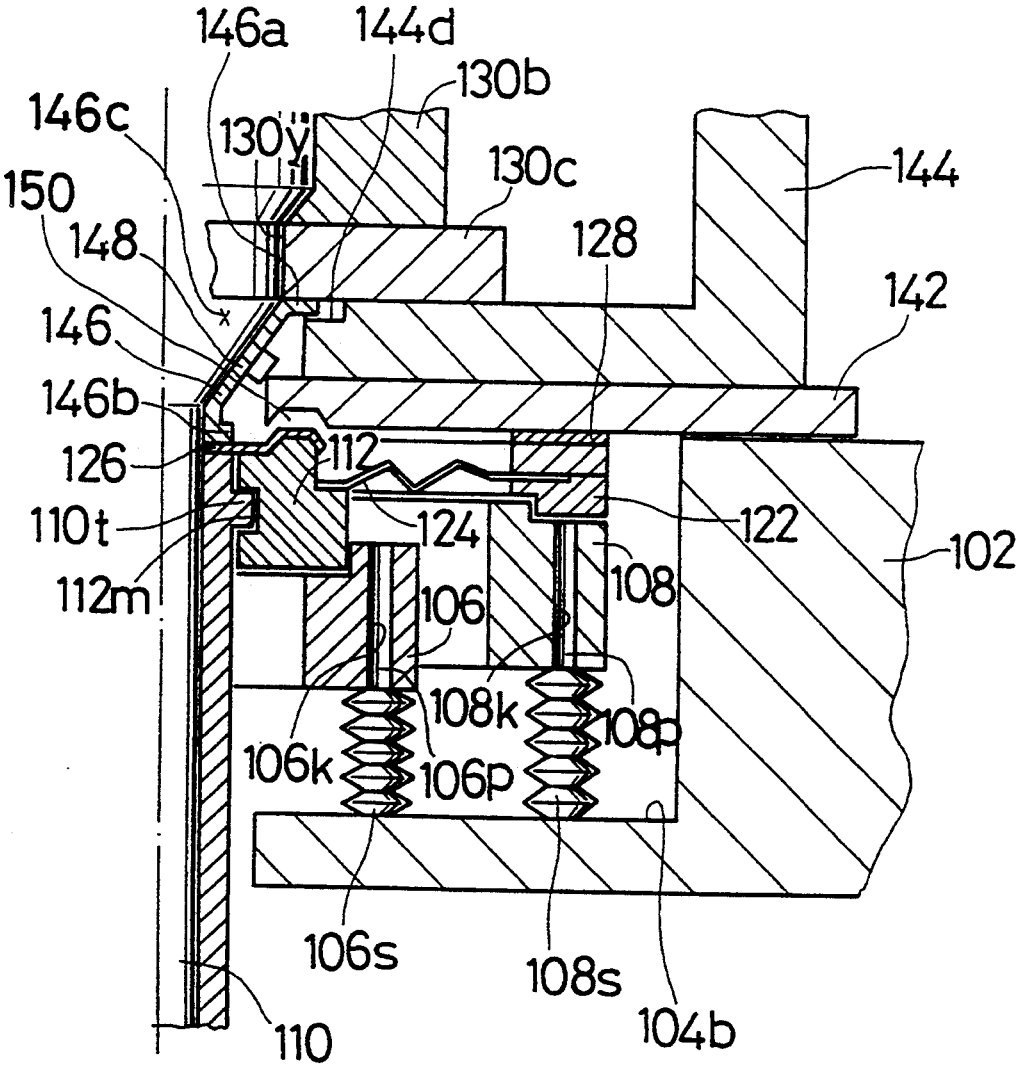
FIG. 2 is a detailed view of the essential parts of FIG. 1.

FIGS. 1 and 2 are a vertical sectional view of a vacuum casting apparatus 100 according to the first embodiment of the present invention and a detailed view of the essential parts of FIG. 1, respectively.

The vacuum casting apparatus 100 is carried by a base member 102. The base member 102 includes a removed portion or a receptacle 104 opening at the upper surface thereof and having a cylindrical side wall and a flat bottom wall **104*b*. The bottom wall 104*b* has a through hole 104*k*. The bottom wall 104*b* is fixedly provided with a plurality of first vertical pins 106*p* each of which acts as a positioning pin for a first annular member 106 (described in detail hereinafter). The first annular member 106 has a plurality of through bores 106*k* corresponding to the first pins 106*p* so as to vertically move along the first pins 106*p*. Further, each of the first pins 106*p* is provided with a first spring 106*s* so that the first annular member 106** is normally upwardly biased.

The bottom wall **104*b* of the receptacle 104 is also fixedly provided with a plurality of second vertical pins 108*p* each of which acts as a positioning pin for an outer annular member or a second annular member 108. The second annular member 108 has a plurality of through bores 108*k* corresponding to the second pins 108*p* so as to vertically move along the second pins 108*p*. Further, each of the second pins 108*p* is provided with a second spring 108*s* so that the second annular member 108** is normally upwardly biased.

The first annular member 106 has a main flange 112 for supporting an upper portion of a cylindrical stoke 110. The main flange 112 is seated on an upper surface **106*j* of the first annular member 106. The stoke 110 is positioned in the receptacle 104 of the base member 102 and is downwardly extended passing through the through hole 104*k*. The stoke 110 at the lower end thereof is immersed in molten metal 202 in a reservoir tank 120 so as to deliver the molten metal 202 into a casting die 130 as described hereinafter. The upper portion of the stoke 110 is provided with an annular flanged portion 110*t* which is engageable with an annular groove 112*m* formed on the inner circumferential surface of the main flange 112. As will be appreciated from the drawings, the annular flanged portion 110*t* of the stoke 110 and the annular groove 112*m* of the main flange 112 are arranged in a manner that when they are engaged with each other, the upper end surface of the stoke 110 is substantially coplanar with the upper surface of the main flange 112. Further, a loose tolerance is provided between the outer circumferential surface of the stoke 110 and the inner circumferential surface of the main flange 112 so as to compensate thermal radial expansion of the stoke 110**.

An auxiliary annular flange 122 is positioned around the main flange 112. The auxiliary flange 122 is seated on an upper surface **108*j* of the second annular member 108. Further, an annular corrugated sealing plate 124 is arranged between the main flange 112 and the auxiliary flange 122** and is tightly engaged thereto.

An enclosure mount 142 is mounted on the base member 102 carrying the vacuum casting apparatus 100 so as to cover the receptacle 104 of the base member 102. The enclosure mount 142 has a central through hole **142*k* having an inner diameter smaller than the outer diameter of the main flange 112. The enclosure mount 142 is arranged on the base member 102 in a manner that the axis of the through hole 142*k* aligns with that of the stoke 110. An annular first sealing member 126 is arranged on the upper surfaces of the main flange 112 and the stoke 110. The first sealing member 126 is held between the upper surface of the main flange 112 and the lower surface of the enclosure mount 142 for forming sealing engagement therebetween. A second sealing member 128 is arranged and is held between the upper surface of the auxiliary flange 122 and the lower surface of the enclosure mount 142** for forming sealing engagement therebetween.

The vacuum casting apparatus 100 includes an enclosure 140 for encapsulating the casting die 130 therein. The enclosure 140 is constituted of a lower die part 144 and an upper die part 149. The lower die part 144 of the enclosure 140 is mounted on the enclosure mount 142. The lower die part 144 has a through hole **144*k* formed on a central portion of a bottom wall thereof and having a diameter greater than that of the through hole 142*k* of the enclosure mount 142. As will be appreciated, the lower die part 144 is arranged on the enclosure mount 142 so that the center line of the through hole 144*k* aligns with that of the through hole 142*k***.

Furthermore, the enclosure 140 has a molten metal sump or funnel member 146 for receiving the molten metal 202 drawn through the stoke 110 and for delivering the same therefrom to a sprue **130*y* of the casting die 130. The funnel member 146 is concentrically arranged in the through holes 142*k*, 144*k*. The funnel member 146 has a lower flanged portion 146*b* which is coupled to the upper surface of the stoke 110 with the first sealing member 126. The funnel member 146 also has an upper flanged portion 146*a* engaged with an annular shoulder portion 144*d* which is formed on the lower die part 144 so as to surround the upper portion of the through hole 144*k*. As will be appreciated from the drawings, a clearance is provided between the outer circumferential surface of the upper flanged portion 146*a* of the funnel member 146 and the inner circumferential surface of the annular shoulder portion 144*d* of the through hole 144*k* of the lower die part 144 so as to absorb thermal radial expansion of the funnel member 146**.

The funnel member 146 is circumferentially provided with a heating element 148 for heating same.

The casting die 130 is centrally positioned on the bottom wall of the lower die part 144. The casting die 130 is constituted of an upper die part **130*a*, a side die part 130*b* and a lower die part 130*c* which form a cavity 131 when they are closed. The sprue 130*y* is formed on the lower die part 130*c* and opens into the cavity 131. As will be appreciated, when the casting die 130 is positioned on the bottom wall of the lower die part 144, the upper flanged portion 146*a* of the funnel member 146 is effectively coupled to the sprue 130*y***.

Thus, the cavity 131 of the casting die 130 is communicated with the reservoir tank 120 through the funnel member 146 and the stoke 110.

Therefore, the funnel member 146 may act as a member for forming a molten metal passage **146*c* which receives the molten metal 202 drawn by the stoke 110 and deliver the same therefrom to a sprue 130*y* of the casting die 130**.

The upper die part 149 is tightly affixed to the lower die part 144 with the casting die 130 mounted on the bottom wall of the lower die part 144. Further, the upper die part 149 has a coupling (not shown) which is connected to a conduit pipe 149*a* communicated with a vacuum pump 149*p*.

In operation, the main flange 112 is interconnected with the auxiliary flange 122 by means of the sealing plate 124 prior to mounting onto the upper portion of the stoke 110. The stoke 110 is inserted into the through hole 104*k* of the base member 102 with the main flange 112 mounted thereon so that the main flange 112 and the auxiliary flange 122 are seated on the upper surface 106*j* of the first annular member 106 and the upper surface 108*j* of the second annular member 108, respectively. As shown in FIG. 1, at this time, the lower end of the stoke 110 is immersed in the molten metal 202 in a reservoir tank 120. As will be easily understood, in this condition, the first and second annular members 106, 108 are upwardly biased under the influence of the first and second springs 106*s*, 108*s*, respectively. Therefore, each of the upper surfaces of the main flange 112, the stoke 110 and the auxiliary flange 122 is upwardly projected from the upper surface of the base member 102.

The first sealing member 126 is subsequently provided on the upper surfaces of the main flange 112 and the stoke 110. Similarly, the second sealing member 128 is provided on the auxiliary flange 122. Thereafter, the enclosure mount 142, the enclosure 140, the funnel member 146 and the casting die 130 are integrally mounted on the base member 102. This completes assembly of the vacuum casting apparatus 100.

Thereafter, the vacuum pump 149*p* is actuated to evacuate the interior of the enclosure 140. Upon evacuation of the interior of the enclosure 140, the cavity 131 is depressurized through clearances (not shown) provided on the upper die part 130*a*, the side die part 130*b* and the lower die part 130*c* whereby the molten metal 202 in the reservoir tank 120 is drawn into the cavity 131 through the stoke 110, the molten metal passage 146*c* formed on the funnel member 146 and the sprue 130*y*.

Under the condition that the molten metal 202 is being drawn into the cavity 131, the stoke 110 and the funnel member 146 are filled with the molten metal 202, and therefore the stoke 110 and the funnel member 146 expand with heat from the molten metal 202. The funnel member 146 further expands with heat developed by the heating element 148 circumferentially provided thereon.

As described above, there is a clearance between the outer circumferential surface of the upper flanged portion 146*a* of the funnel member 146 and the inner circumferential surface of the annular shoulder portion 144*d*. Therefore, the radial expansion of the funnel member 146 is effectively absorbed by such a clearance.

On the other hand, the vertical expansion of the funnel member 146 acts as force for upwardly biasing the lower die part 130*c* of the casting die 130 through the upper flanged portion 146*a* of the funnel member 146 and for downwardly biasing the stoke 110 through the lower flanged portion 146*b* of the funnel member 146. However, since the funnel member 146 is downwardly urged by the casting die 130, the vertical expansion of the funnel member 146 causes downward motion of the lower flanged portion 146*b* other than upward motion of the upper flanged portion 146*a*. Upon downward motion of the lower flanged portion 146*b*, as shown in FIG. 2, the stoke 110 and the main flange 112 associated with the stoke 110 are lowered against spring force of the first spring 106*s*, thereby to form a clearance 150 between the upper surface of the main flange 112 and the lower surface of the enclosure mount 142.

As described above, the auxiliary flange 122 is separate from the main flange 112. Therefore, the auxiliary flange 122 remains in contact with the lower surface of the enclosure mount 142 with the second sealing member 128 therebetween even if the the stoke 110 and the main flange 112 are downwardly moved. It is important to note that the sealing plate 124 is provided on the main flange 112 and the auxiliary flange 122 so as to tightly cover the space between the main flange 112 and the auxiliary flange 122, thereby to effectively prevent air flow into the enclosure 140 through the clearance 150.

When the molten metal 202 in the casting die 130 is completely set out, the vacuum pump 149*p* is deactuated to resume the pressure in the enclosure 140. This causes the molten metal 202 in the funnel member 146 and the stoke 110 to draw back into the reservoir tank 120 by gravity. Threrafter, the casting die 130 is opened to release a product therefrom.

This construction remarkably enhances sealing performance between the lower surface of the enclosure 140 and the stoke 110, thereby to prevent air inclusion into the molten metal 202 and seepage of air into the enclosure 140. This may result to improvement of casting products in quality.

A second embodiment modified from the first embodiment of the present invention will now be described with reference to FIG. 3, wherein only parts of different from those shown in FIGS. 1 and 2 will be explained.

Figure 3:
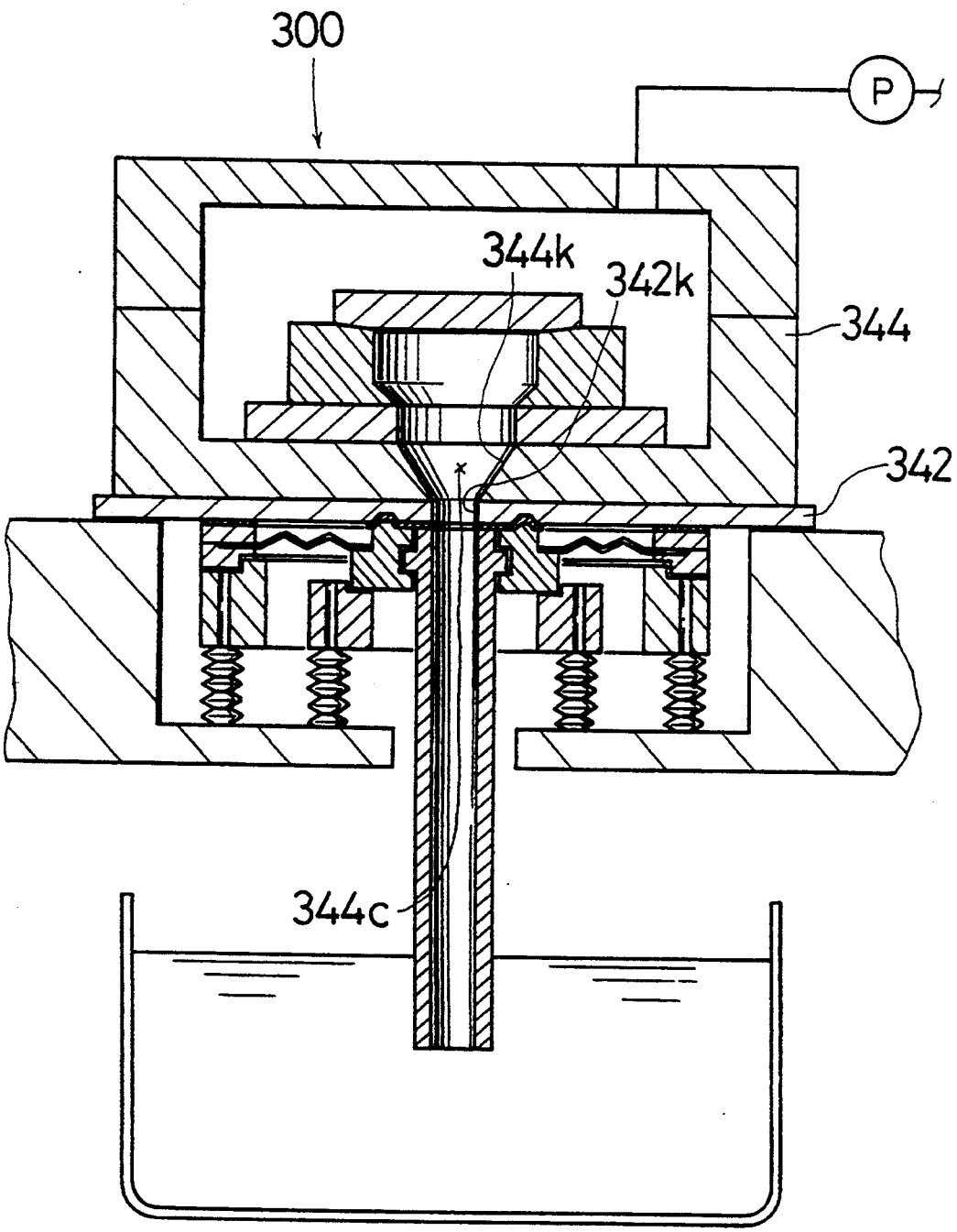
FIG. 3 is a vertical sectional view of a vacuum casting apparatus according to a second embodiment of the present invention.
Figure 4:
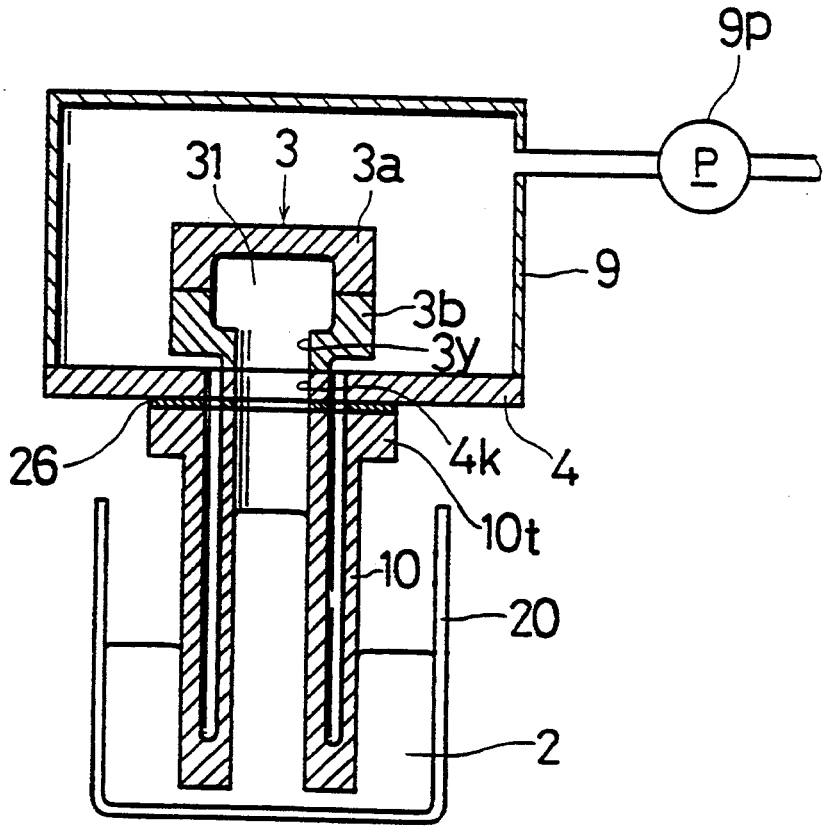
FIG. 4 (PRIOR ART)
FIG. 4 is a vertical sectional view of a conventional vacuum casting apparatus.

As shown in FIG. 3, a vacuum casting apparatus 300 of the second embodiment does not includes members comparable to the funnel member 146 and the heating member 148 in the first embodiment. In this embodiment, a through hole 342*k* of an enclosure mount 342 and a through hole 344*k* of a lower die part 344 cooperate to form a molten metal passage 344*c*.

The preferred embodiments herein described are intended to be illustrative of the invention and not to limit the invention to the precise form herein described. They are chosen and described to explain the principles of the invention and their application and practical use to enable others skilled in the art to practice the invention.

What is claimed is:

1. A vacuum casting apparatus including a casting die having a cavity and an enclosure encapsulating said casting die, said enclosure being evacuated to depressurize said cavity so that molten metal is drawn into said cavity from a reservoir tank positioned outside said enclosure, comprising:

a molten metal passage for delivering the molten metal into a sprue of said casting die encapsulated in said enclosure from outside of said enclosure;

a cylindrical stoke for communicating said molten metal passage with said reservoir tank, said stoke having an inner bore for flowing the molten metal;

a main flange for biasing one end of said stoke to one end of a member on which said molten metal passage is formed;

an auxiliary flange positioned around said main flange, said auxiliary flange including a sealing member contacting a surface of said enclosure; and a flexible plate member positioned between said main flange and said auxiliary flange, for air tightly closing a space between said main flange and said auxiliary flange.

2. The vacuum casting apparatus as defined in claim 1 wherein said main flange and said auxiliary flange having an annular configuration, said auxiliary flange having a diameter greater than that of said main flange.

3. The vacuum casting apparatus as defined in claim 2 further comprising a base member having a receptacle, a first annular member and a second annular member, said first and second annular members being adapted to move up and down along guide pins affixed to said base member, said annular main flange and said annular auxiliary flange being received in said receptacle and seated on said first annular member and said second annular member, respectively.

4. The vacuum casting apparatus as defined in claim 1, wherein said flexible plate member is formed of a corrugated plate.

5. The vacuum casting apparatus as defined in claim 3 wherein said first and second annular members are upwardly biased by springs.

* * * * *